US009362066B2

(12) United States Patent
Izawa

(10) Patent No.: US 9,362,066 B2
(45) Date of Patent: Jun. 7, 2016

(54) SWITCH

(71) Applicant: OMRON CORPORATION, Kyoto-shi (JP)

(72) Inventor: Kazuhira Izawa, Okayama (JP)

(73) Assignee: OMRON CORPORATION, Kyoto-shi, Kyoto (JP)

( * ) Notice: Subject to any disclaimer, the term of this patent is extended or adjusted under 35 U.S.C. 154(b) by 118 days.

(21) Appl. No.: 14/187,736

(22) Filed: Feb. 24, 2014

(65) Prior Publication Data

US 2014/0251778 A1 Sep. 11, 2014

(30) Foreign Application Priority Data

Mar. 8, 2013 (JP) ..... 2013-047291

(51) Int. Cl.

| | |
|---|---|
| ***H01H 3/42*** | (2006.01) |
| ***H01H 13/20*** | (2006.01) |
| ***H01H 13/02*** | (2006.01) |
| ***H01H 13/12*** | (2006.01) |
| *H01H 1/00* | (2006.01) |

(52) U.S. Cl.

CPC ..... *H01H 13/20* (2013.01); *H01H 3/42* (2013.01); *H01H 13/023* (2013.01); *H01H 13/12* (2013.01); *H01H 2001/0005* (2013.01)

(58) Field of Classification Search

CPC ..... H01H 13/20; H01H 13/023; H01H 13/42; H01H 13/12; H01H 2001/0005

USPC ..... 200/533, 239, 241, 242, 244–246, 250, 200/271, 272, 275

See application file for complete search history.

(56) References Cited

U.S. PATENT DOCUMENTS

| | | | | |
|---|---|---|---|---|
| 3,924,090 | A | 12/1975 | Chao | |
| 4,339,643 | A | 7/1982 | Murmann | |
| 4,467,160 | A * | 8/1984 | Murmann et al. | 200/536 |
| 4,495,391 | A * | 1/1985 | Kitao et al. | 200/526 |
| 4,751,385 | A * | 6/1988 | Van Benthusysen et al. | 200/314 |
| 4,760,225 | A * | 7/1988 | Takano | 200/533 |
| 7,514,643 | B1 | 4/2009 | Tittle | |

FOREIGN PATENT DOCUMENTS

| | | | |
|---|---|---|---|
| GB | 2066578 | A | 7/1981 |
| JP | S56-093221 | A | 7/1981 |
| JP | S58-150232 | U | 10/1983 |
| JP | 08504050 | A | 4/1996 |

(Continued)

OTHER PUBLICATIONS

European Search Report for corresponding application 14154126.8; Report Dated Jun. 24, 2014.

(Continued)

*Primary Examiner* — Renee Luebke
*Assistant Examiner* — Lheiren Mae A Caroc
(74) *Attorney, Agent, or Firm* — Shinjyu Global IP

(57) ABSTRACT

A space where a member is disposed is ensured in a central portion without changing dimensions of an appearance. In a push-button switch, a movable contact portion is disposed while bent in an outer peripheral space between an insertion pipe and sidewalls constituting a quadratic-prism lower case, and the sidewall closest to a position where a projected terminal portion is disposed differs from the sidewall closest to a position where an abutment portion is disposed.

20 Claims, 9 Drawing Sheets

(56) References Cited

FOREIGN PATENT DOCUMENTS

| | | | |
|---|---|---|---|
| JP | H11-162280 | A | 6/1999 |
| JP | 2007329070 | A | 12/2007 |

OTHER PUBLICATIONS

The Office Action from the corresponding Japanese Patent Application No. 2013-047291 issued on May 7, 2015.

* cited by examiner

FP
(OFF)

TTP
(ON)

SWITCH

CROSS REFERENCE TO RELATED APPLICATION

This application is related to and claims priority to Japanese Patent Application No. 2013-047291 filed on 8 Mar. 2013, the contents of which are herein incorporated by reference in their entirety.

BACKGROUND OF THE INVENTION

1. Technical Field

The present invention relates to a switch, particularly to a push-button switch.

2. Related Art

Conventionally, for example, International Patent Publication No. 8-504050 discloses a flat key switch as a switch in which a contact can be opened and closed by a pressing operation. FIG. 11 is an exploded perspective view illustrating a configuration of the flat key switch disclosed in International Patent Publication No. 8-504050.

As illustrated in FIG. 11, a key switch 100 of International Patent Publication No. 8-504050 is accommodated in a housing including a lower portion 110 and a lid portion 120 covering the lower portion 110. The key switch 100 is opened and closed by switching between contact and non-contact of a fixed contact piece 144 and a contact shoe 146. The contact shoe 146 is constructed by a cyclic thin-plate 150. When a push-rod 130 is pushed in, the cyclic thin-plate 150 is bent in a direction perpendicular to a direction, in which the push-rod 130 is pushed in, by an opening and closing cam 140 provided in the push-rod 130. The contact shoe 146 constructed by the cyclic thin-plate 150 moves relative to the fixed contact piece 144 to come into contact with or separate (becomes the non-contact) from the fixed contact piece 144. Thus, the key switch 100 of International Patent Publication No. 8-504050 is opened and closed by switching between the contact and the non-contact of the fixed contact piece 144 and the contact shoe 146 in the direction perpendicular to the direction in which the push-rod 130 is pushed in. Therefore, the key switch 100 is suitable for the switch in which an appearance has a flat structure.

However, in the key switch of International Patent Publication No. 8-504050, unfortunately it is necessary to enlarge dimensions of the appearance when a member is disposed in a center of the key switch.

In the key switch 100 of International Patent Publication No. 8-504050, the contact shoe 146 constructed by the cyclic thin-plate 150 is disposed on a side of one of side surfaces constituting a quadratic prism of the lower portion 110. The cyclic thin-plate 150 has a cyclic structure because the cyclic thin-plate 150 is bent in the direction perpendicular to the direction in which the push-rod 130 is pushed in. Because a certain degree of flexibility is provided to the cyclic structure, the dimensions of the cyclic thin-plate 150 are enlarged in the direction perpendicular to the direction in which the push-rod 130 is pushed in.

Thus, a space of the contact shoe 146 constructed by the cyclic thin-plate 150 is enlarged in the key switch of International Patent Publication No. 8-504050. Therefore, it is difficult that the member is disposed in the center of the key switch without changing the dimensions of the appearance. For example, in a lighted push-button switch, desirably an LED light source is disposed in a central position with respect to a button operating surface such that the button operating surface is homogeneously illuminated with light. In the case where the key switch of International Patent Publication No. 8-504050 is applied to the lighted push-button switch, it is difficult that the LED is disposed in the center of the operating surface of the key switch without changing the dimensions of the appearance. It is necessary to enlarge the dimensions of the appearance of the key switch in order to dispose the LED in the center of the operating surface of the key switch.

SUMMARY

The present invention has been devised to solve the problems described above, and provides a switch in which the space where the member is disposed can be ensured in the center without changing the dimensions of the appearance.

The invention provides a switch including: a contact mechanism that has an opening and closing unit, the opening and closing unit including a movable contact and a fixed contact; a casing having a polygonal-column box shape, a central space of the casing being defined by an internal wall; and a pressing member that is attached while being vertically movable in an axial direction of the polygonal column in a space of the casing, the pressing member including a cam shape in which a dimension in a horizontal direction perpendicular to the axial direction varies in the axial direction, where the contact mechanism includes a plate-like member having a support supported by the casing, the plate-like member having a movable contact portion in which the movable contact is provided, the movable contact portion abutting on the cam shape and being elastically deformed in the horizontal direction in conjunction with the vertical movement, the movable contact being movable horizontally to come into contact with or separate from the fixed contact by an elastic deformation of the movable contact portion, the movable contact portion is disposed while bent in an outer peripheral space between the internal wall and sidewalls constituting the polygonal column, and the sidewall closest to a position where the support is disposed differs from the sidewall closest to a position where a portion coming into contact with the cam shape is disposed.

DETAILED DESCRIPTION

First Embodiment

Figure 1:
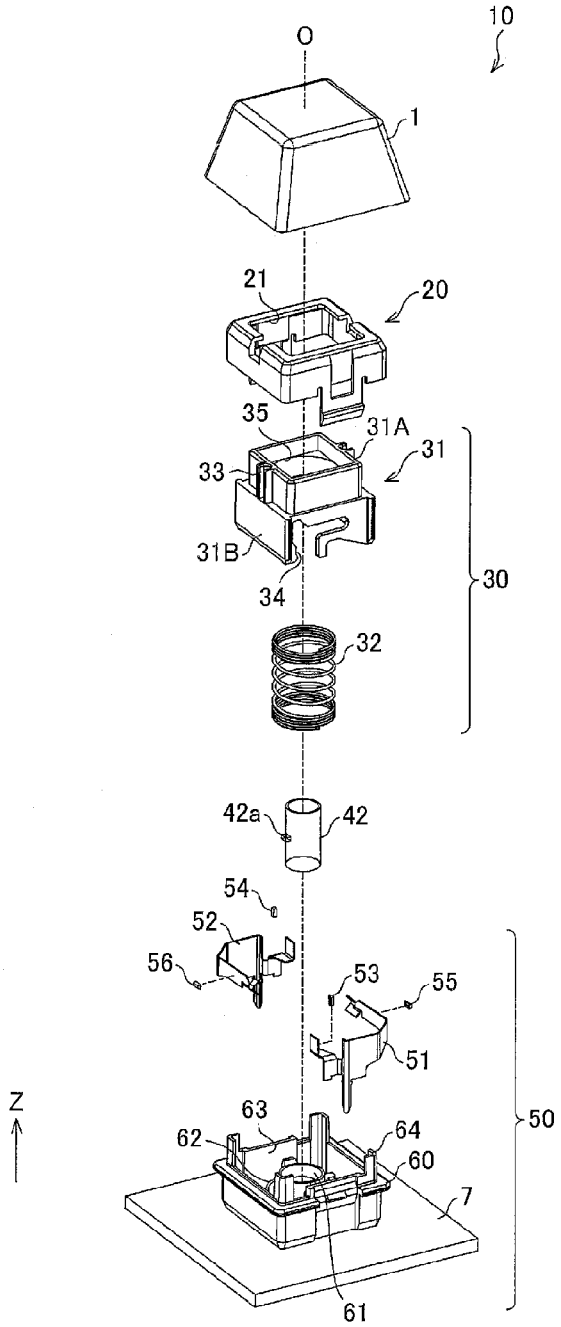
FIG. 1 is an exploded perspective view illustrating a configuration of a push-button switch according to a first embodiment of the present invention.
Figure 2:
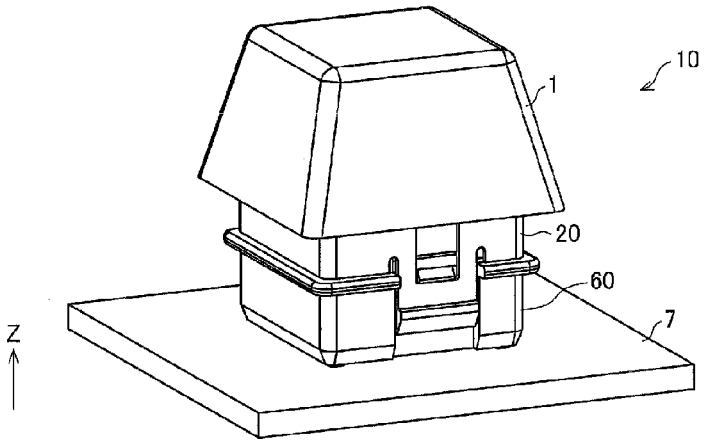
FIG. 2 is a perspective view illustrating an appearance of the push-button switch.
Figure 3:
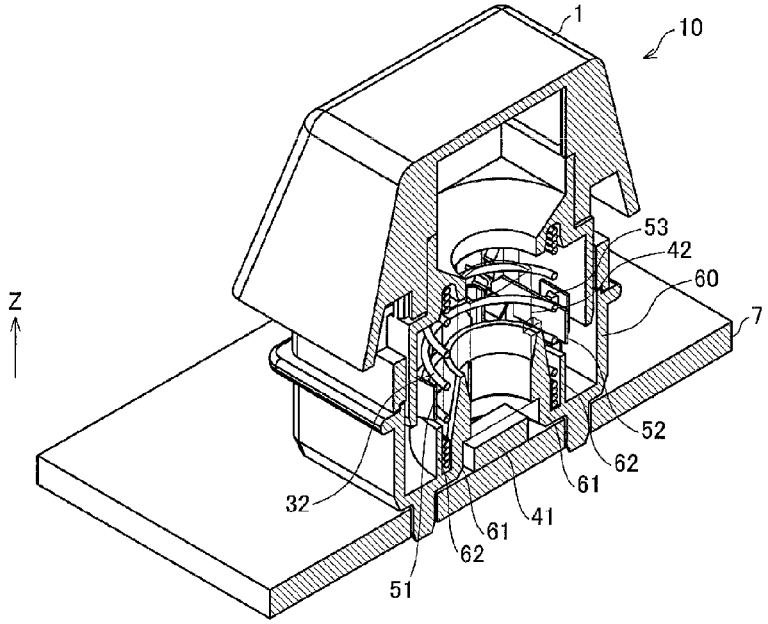
FIG. 3 is a sectional perspective view illustrating the configuration of the push-button switch.

Hereinafter, embodiments of the present invention will be described with reference to the drawings. FIG. 1 is an exploded perspective view illustrating a configuration of a push-button switch 10 according to a first embodiment. FIG. 2 is a perspective view illustrating an appearance of the push-button switch 10. FIG. 3 is a sectional perspective view illustrating the configuration of the push-button switch 10. FIGS. 2 and 3 illustrate a non-pressing state.

The push-button switch 10 of the first embodiment is a contact type switch, and has the configuration particularly suitable for a lighted switch assembled in a keyboard, an industrial operation panel, an operation panel of a business-use video instrument, and a consumer product.

As illustrated in FIGS. 1 to 3, the push-button switch 10 includes a keytop 1, an upper case 20 (casing), a plunger unit 30, a light source 40, a contact mechanism 50, a lower case 60 (casing), and a board 7. The upper case 20 is fitted in the lower case 60 to cover the contact mechanism 50 and support the plunger unit 30 such that the plunger unit 30 is vertically movable. The light source 40 includes an LED 41 and a light guide rod 42. As illustrated in FIG. 3, the LED 41 is mounted on the board 7. The plunger unit 30 includes a plunger body (push-in member) 31 and a helical spring 32. At this point, a direction in which the push-button switch is pushed in is assumed to be a Z-direction. In the Z-direction, a side of the keytop 1 is assumed to be an upper side, and a side of the board 7 is assumed to be a lower side.

A hole 21 in which an upper portion 31A of the plunger body 31 can be inserted is made in the upper case 20. An engagement groove 33 to engage the keytop 1 is formed in the upper portion 31A of the plunger body 31. Therefore, the upper portion 31A of the plunger body 31 engages the keytop 1 while inserted in the hole 21 of the upper case 20.

The lower case 60 has a quadratic-prism box shape, and is attached to the board 7 as illustrated in FIG. 1. When viewed from above, a communication pipe 61 (internal wall) communicated to the board 7 is formed in a substantial center of the lower case 60. The light source 40 is accommodated in the communication pipe 61. Specifically, the LED 41 mounted on the board 7 is disposed immediately above the communication pipe 61. The light guide rod 42 is inserted in the communication pipe 61, and supported in a predetermined position by engagement between a latching portion 42*a* and a communication pipe 61. Light from the LED 41 is coupled to the light guide rod 42, is guided in the light guide rod 42, and exits upward.

An insertion pipe 62 (internal wall) is formed in the lower case 60 so as to surround the communication pipe 61. The insertion pipe 62 is configured to neither pierce a bottom surface of the lower case 60 nor be communicated to the board 7. The helical spring 32 of the plunger unit 3 is accommodated in a space between an outer wall of the communication pipe 61 and an inner wall of the insertion pipe 62. That is, in the lower case 60, a central space is defined by the communication pipe 61 and the insertion pipe 62. The contact mechanism 50 is accommodated in a space (outer peripheral space) surrounded by an outer wall (internal wall) of the insertion pipe 62 and a sidewall 63 of the lower case 60.

When viewed from above, a projected corner portion 64 that is projected upward while a shape of the corner portion is maintained is formed in each rectangular corner portion formed by the sidewalls 63. A lower portion of the plunger body 31 of the plunger unit 30 has a shape that can be supported by the four projected corner portions 64. In pressing the push-button switch 10, the projected corner portion 64 acts as a guide portion that guides the plunger body 31 downward. The plunger body 31 is disposed while being in contact with the upper portion of the helical spring 32. The helical spring 32 is accommodated in the lower case 60 such that an elastic force acts in a direction opposite to a pressing force when the plunger body 31 is pressed.

Figure 4A:
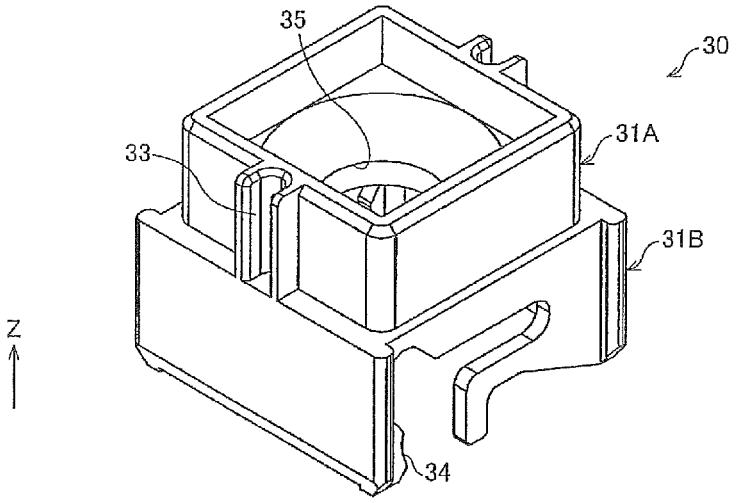
FIG. 4A is a perspective view illustrating a configuration of a plunger body in the push-button switch illustrated in FIGS. 1 to 3.
Figure 4B:
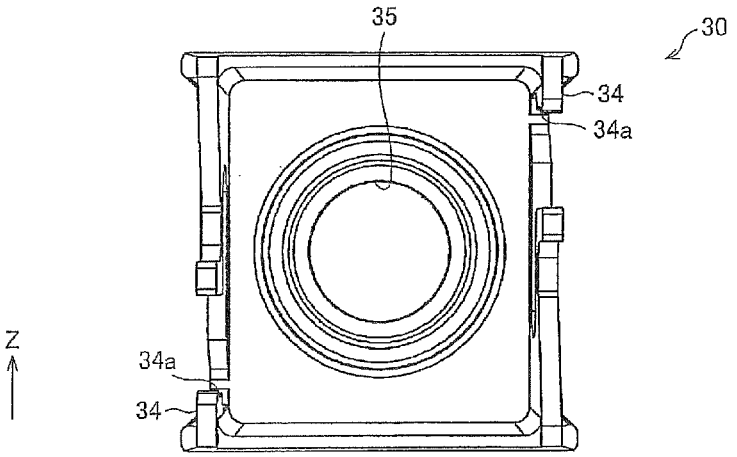
FIG. 4B is a plan view illustrating the configuration of the plunger body when viewed from a lower side.

FIG. 4A is a perspective view illustrating the configuration of the plunger body 31, and FIG. 4B is a plan view illustrating the configuration of the plunger body 31 when viewed from a lower side. As illustrated in FIGS. 4A and 4B, a cam portion 34 (cam shape) to engage the contact mechanism 50 is formed in a lower portion 31B of the plunger body 31. A hole 35 in which the light guide rod 42 can be inserted is made in a central portion of the plunger body 31. As illustrated in FIG. 4B, the cam portion 34 includes a concave-convex surface (cam shape) 34*a* that is formed in a concave-convex manner in a horizontal direction perpendicular to the Z-direction.

Figure 5:
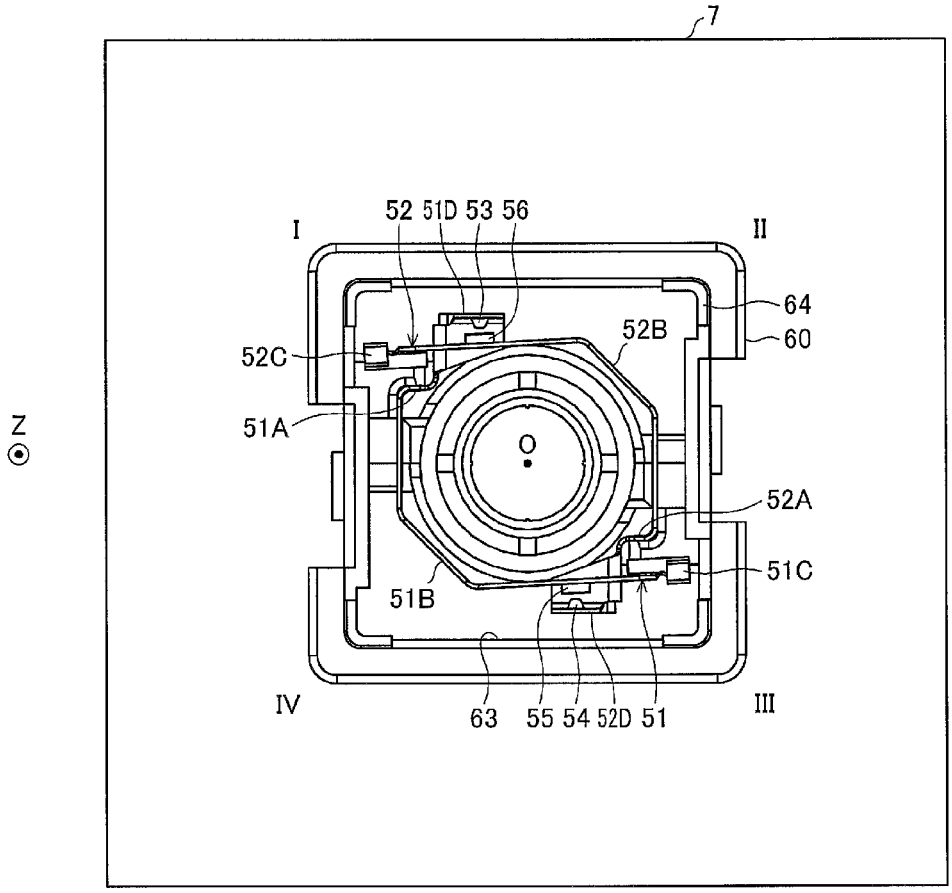
FIG. 5 is a plan view illustrating a configuration of a contact mechanism accommodated in a lower case in the push-button switch illustrated in FIGS. 1 to 3 when viewed from an upper side.
Figure 6A:
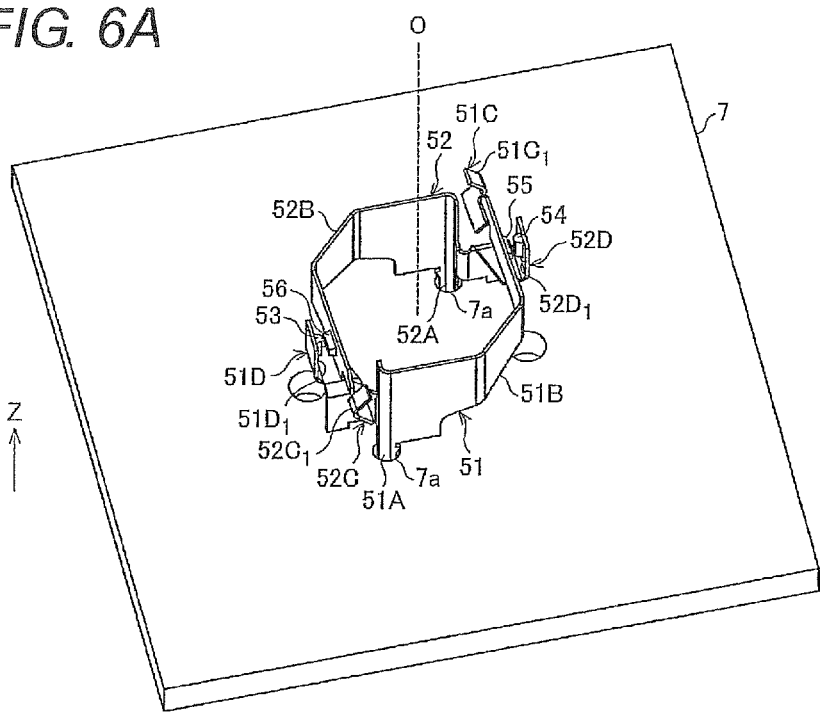
FIG. 6A is a perspective view illustrating the configuration of the contact mechanism provided on a board in the push-button switch illustrated in FIGS. 1 to 3.

The configuration of the contact mechanism 50 will be described in detail with reference to FIGS. 5, 6A, and 6B. FIG. 5 is a plan view illustrating the configuration of the contact mechanism 50 accommodated in the lower case 60 when viewed from an upper side. FIG. 6A is a perspective view illustrating the configuration of the contact mechanism 50 provided on the board 7, and FIG. 6B is a side view illustrating the configuration of the contact mechanism 50.

Figure 6B:
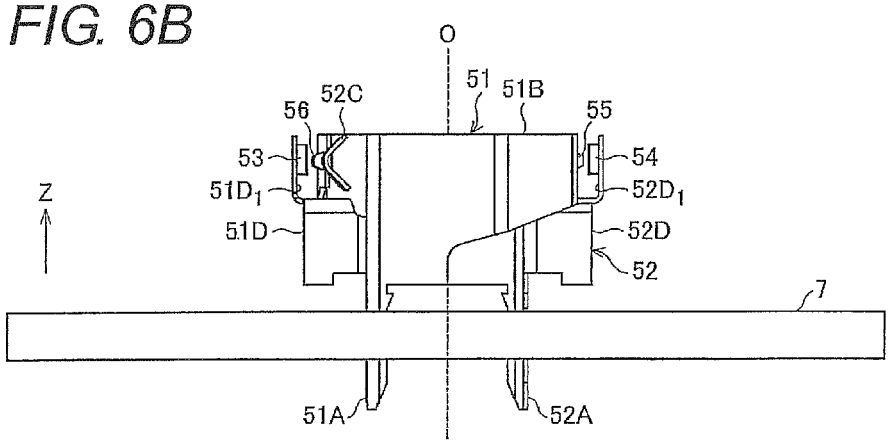
FIG. 6B is a side view illustrating the configuration of the contact mechanism.

As illustrated in FIGS. 5, 6A, and 6B, the contact mechanism 50 includes movable plates 51 and 52, fixed contacts 53 and 54, and movable contacts 55 and 56. The fixed contact 53 and the movable contact 55 are provided in the movable plate 51, and the fixed contact 54 and the movable contact 56 are provided in the movable plate 52. As illustrated in FIG. 6A, through-holes 7*a* are made in the board 7 in order to support the movable plates 51 and 52. The movable plates 51 and 52 include projected terminal portions 51A and 52A (supports), which are connected to the outside while piercing the through-holes 7*a*. The movable plates 51 and 52 are supported by the board 7 with the projected terminal portions 51A and 52A interposed therebetween. The movable plates 51 and 52 are made of a conductive material.

When viewed from above, the movable plates 51 and 52 include movable contact portions 51B and 52B that are bent into a substantial L-shape from the projected terminal portions 51A and 52A. In the movable contact portions 51B and 52B, abutment portions 51C and 52C abutting on the cam portion 34 of the plunger body 31 are provided in end portions on the sides opposite to the projected terminal portions 51A and 52A. The abutment portions 51C and 52C have an outwardly-projected V-shape. In the push-button switch 10, apex portion $51C_1$ and $52C_1$ of the V-shape abutment portions 51C and 52C abut on the concave-convex surface 34*a* of the cam portion 34. The movable contact portions 51B and 52B are biased outward in the direction perpendicular to the Z-direction in the state in which the apex portion $51C_1$ and $52C_1$ of the abutment portions 51C and 52C abut on the concave-convex surface 34*a*. During a pressing motion of the switch, the movable contact portions 51B and 52B act as leaf springs that are elastically deformed in the direction perpendicular to the Z-direction with the projected terminal portions 51A and 52A as support points and with the abutment portions 51C and 52C as power points.

Thus, the movable contact portions 51B and 52B are disposed while bent in an outer peripheral space between the insertion pipe 62 and the sidewall 63. The bent portions of the movable contact portions 51B and 52B are not limited to the bent configuration in which the plate (plate portion) is folded as illustrated in FIGS. 5 and 6. Alternatively, for example, the bent portions may be constructed by curved surfaces that are formed by curvature of the plate (plate portion).

In the movable plates 51 and 52, fixed supports 51D and 52D are formed in portions different from the portions in which the movable contact portions 51B and 52B are provided in the projected terminal portions 51A and 52A. Unlike the movable contact portions 51B and 52B, the fixed supports 51D and 52D are configured not to be deformed during the pressing motion of the switch. The fixed supports 51D and 52D are formed as standing pieces that stand from the lower side below the movable contact portions 51B and 52B, and the fixed supports 51D and 52D include surfaces 51$D_1$ and 52$D_1$ extending in the Z-direction.

In the movable plate 51, the fixed contact 53 is attached to the surface 51$D_1$ of the fixed support 51D. The movable contact 55 is attached to an outside surface of the movable contact portion 51B. In the movable plate 52, the fixed contact 54 is attached to the surface 52$D_1$ of the fixed support 52D. The movable contact 56 is attached to the outside surface of the movable contact portion 52B.

A positional relationship between the movable plates 51 and 52 in the lower case 60 will be described below. As illustrated in FIG. 5, each of the movable contact portions 51B and 52B of the movable plates 51 and 52 is disposed while bent in the outer peripheral space between the insertion pipe 62 and the sidewalls 63 constituting the quadratic-prism lower case 60. The sidewalls 63 closest to the positions where the projected terminal portions 51A and 52A are disposed differ from the sidewalls 63 closest to the positions where the abutment portions 51C and 52C coming into contact with the concave-convex surfaces 34*a* are disposed.

As illustrated in FIG. 5, the projected terminal portion 51A of the movable plate 51 is disposed in a space of a corner portion I of the quadratic-prism lower case 60. The movable contact portion 51B is disposed from the projected terminal portion 51A along two sides I-IV and IV-III among four sides of a quadrangle formed by the sidewalls 63 of the lower case 60. That is, the movable contact portion 51B extends from the projected terminal portion 51A astride the corner portion IV. The abutment portion 51C, which is the end portion on the side opposite to the projected terminal portion 51A in the movable contact portion 51B, is disposed in the space of the corner portion III. The projected terminal portion 52A of the movable plate 52 is disposed in the space of the corner portion III in the quadratic-prism lower case 60. The movable contact portion 52B is disposed from the projected terminal portion 52A along two sides III-II and II-I among the four sides of the quadrangle formed by the sidewalls 63 of the lower case 60. That is, the movable contact portion 52B extends from the projected terminal portion 52A astride the corner portion II. The abutment portion 52C, which is the end portion on the side opposite to the projected terminal portion 52A in the movable contact portion 52B, is disposed in the space of the corner portion I.

The fixed support 51D is formed in a portion different from a portion in which the movable contact portion 51B is provided in the projected terminal portion 51A, and the fixed support 51D is disposed in the space of the corner portion I. The fixed support 52D is formed in a portion different from a portion in which the movable contact portion 52B is provided in the projected terminal portion 52A, and the fixed support 52D is disposed in the space of the corner portion III.

According to the configuration of the push-button switch 10, the movable plates 51 and 52 that are of the main structural elements in the contact mechanism 50 are disposed along the sidewalls 63 while avoiding the central space of the lower case 60. The movable plates 51 and 52 have not the cyclic shape disclosed in International Patent Publication No. 8-504050, but have the plate shape. The movable contact portions 51B and 52B are disposed while bent in the outer peripheral space between the insertion pipe 62 and the sidewalls 63 constituting the quadratic-prism lower case 60. The sidewalls 63 closest to the positions where the projected terminal portions 51A and 52A are disposed differ from the sidewalls 63 closest to the positions where the abutment portions 51C and 52C coming into contact with the concave-convex surfaces 34*a* are disposed. Therefore, a distance between each of the projected terminal portions 51A and 52A that are of the support points and each of the abutment portions 51C and 52C that are of the power points is lengthened, so that the force necessary to generate the elastic deformation of each of the movable contact portions 51B and 52B can be reduced. As to a technique of lengthening the distance between the support point and the power point, for example, the movable contact portions 51B and 52B are configured to be bent along the sidewalls 63, so that the outer peripheral space between the insertion pipe 62 and the sidewalls 63 constituting the quadratic-prism lower case 60 can be reduced. Therefore, a volume of the central space can be enlarged without changing dimensions of the lower case 60 while the spaces for the movable plates 51 and 52 are reduced in the lower case 60.

As a result, in the configuration of the push-button switch 10, the space where the member is disposed can be ensured in the center of the lower case 60 without changing the dimension of the appearance of the switch.

As illustrated in FIGS. 1 to 3, in the push-button switch 10 of the first embodiment, the light source 40 including the LED 41 and the light guide rod 42 is disposed in the ensured central space of the lower case 60. Therefore, the lighted push-button switch in which a button operating surface (the upper surface of the keytop 1) homogeneously emits light can be constructed without changing the dimensions of the appearance.

The positional relationship between the movable plates 51 and 52 in the contact mechanism 50 will be described below. As illustrated in FIGS. 5, 6A, and 6*b*, the movable plates 51 and 52 have the axisymmetrically positional relationship with respect to a central axis O extending in the Z-direction when viewed from above.

The movable plate 51 is disposed such that the movable contact 55 provided in the movable contact portion 51B is opposed to the fixed contact 54 provided in the surface 52$D_1$ of the fixed support 52D in the movable plate 52. On the other hand, the movable plate 52 is disposed such that the movable contact 56 provided in the movable contact portion 52B is opposed to the fixed contact 53 provided in the surface 51$D_1$ of the fixed support 51D in the movable plate 51.

In the push-button switch 10, electrical contact between the movable contact 55 provided in the movable plate 51 and the fixed contact 54 provided in the movable plate 52 and electrical contact between the movable contact 56 provided in the movable plate 52 and the fixed contact 53 provided in the movable plate 51 are opened and closed. The contact mechanism 50 includes the two contact opening and closing mechanisms, so that contact reliability between the movable contact and fixed contact of the push-button switch 10 can be improved. The movable plate 51 and the movable plate 52 have the identical shape. Therefore, components of the movable plate 51 and the movable plate 52 can be shared with each other to reduce production cost.

In the push-button switch 10, the movable plates 51 and 52 have the axisymmetrically positional relationship with respect to the central axis O extending in the Z-direction when viewed from above. A point at which the movable contact 55 and the fixed contact 54 are opened and closed and a point at which the movable contact 56 and the fixed contact 53 are opened and closed also have the axisymmetrically positional relationship with respect to the central axis O extending in the Z-direction. That is, the opening and closing unit constructed by the movable contact 55 and fixed contact 54 and the opening and closing unit constructed by the movable contact 56 and fixed contact 53 are axisymmetrical with respect to the central axis O. When the push-button switch 10 is pressed to open and close the electrical contact, orientations of the forces applied to the two points at each of which the movable contact and the fixed contact are opened and closed become axisymmetrical with respect to the central axis O. During the pressing operation of the push-button switch 10, the force is not applied to the plunger body 31 while biased toward one direction, but the force is evenly applied to the plunger body 31 in the direction perpendicular to the Z-direction. For example, the plunger body 31 is not pressed while being in contact with a specific position of the upper case 20. As a result, abrasion of a specific portion of the plunger body 31 can be prevented to lengthen a lifetime of the switch.

An example of a method for assembling the push-button switch 10 will be described below. First the lower case 60 in which the contact mechanism 50 is assembled is attached to the board 7 on which the LED 41 is mounted.

Then the light guide rod 42 is inserted in the communication pipe 61 of the lower case 60 to optically couple the LED 41 and the light guide rod 42 to each other. Then the helical spring 32 is inserted in the insertion pipe 62 of the lower case 60. At this point, the light guide rod 42 is accommodated in the helical spring 32.

Then the plunger body 31 is attached to the lower case 60 from above the helical spring 32 such that the four corners of the plunger body 31 are accommodated in the four projected corner portions 64. At this point, the apex portions 51$C_1$ and 52$C_1$ of the abutment portions 51C and 52C in the movable plates 51 and 52 abut on the concave-convex surface 34*a* of the cam portion 34 such that the movable contact portions 51B and 52B are displaced outward. Therefore, the movable contact 55 provided in the movable contact portion 51B is separated from the fixed contact 54 provided in the fixed support 52D. The movable contact 56 provided in the movable contact portion 52B is separated from the fixed contact 53 provided in the fixed support 51D.

Then the upper case 20 and the keytop 1 are sequentially attached to complete the push-button switch 10.

Figure 7:
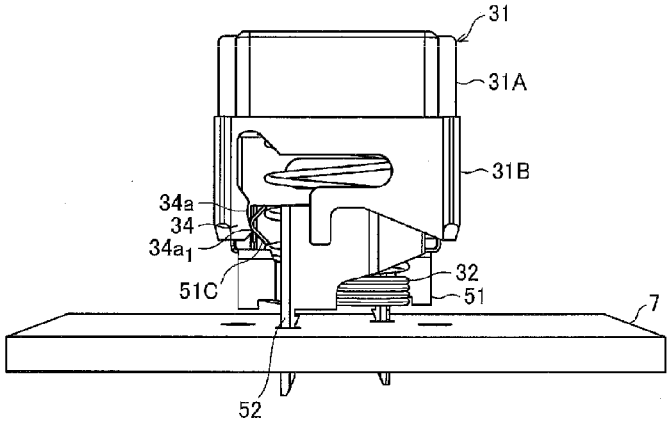
FIG. 7 is a side view illustrating an engagement state between the plunger body and a movable plate before operation of the push-button switch illustrated in FIGS. 1 to 3.
Figure 8A:
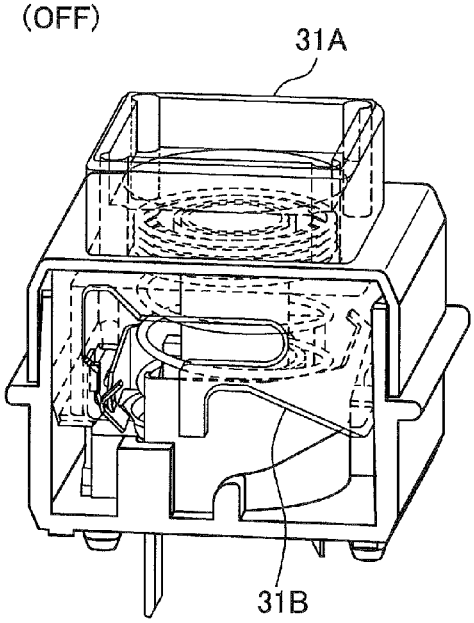
FIGS. 8A and 8C are sectional perspective views illustrating an operating process of the push-button switch illustrated in FIGS. 1 to 3, and FIGS. 8B and 8D are partially enlarged views illustrating motions of an abutment portion of a movable plate and a cam portion of the plunger body.
Figure 8B:
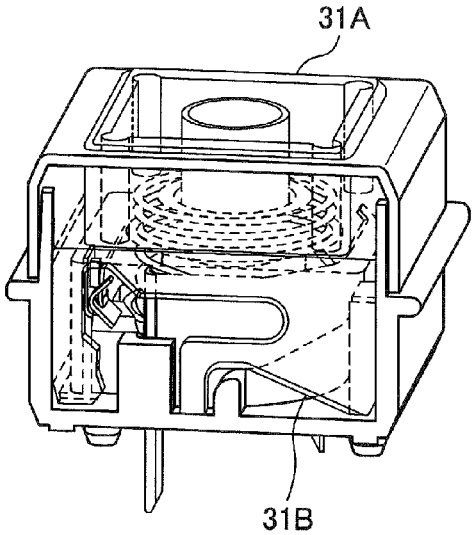
Figure 8C:
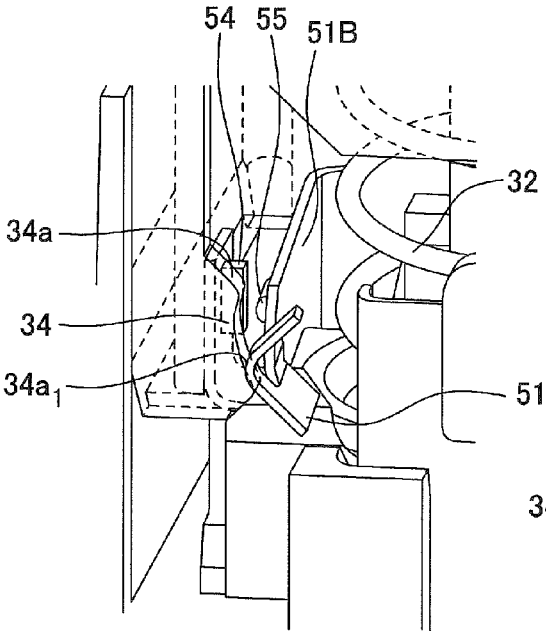
Figure 8D:
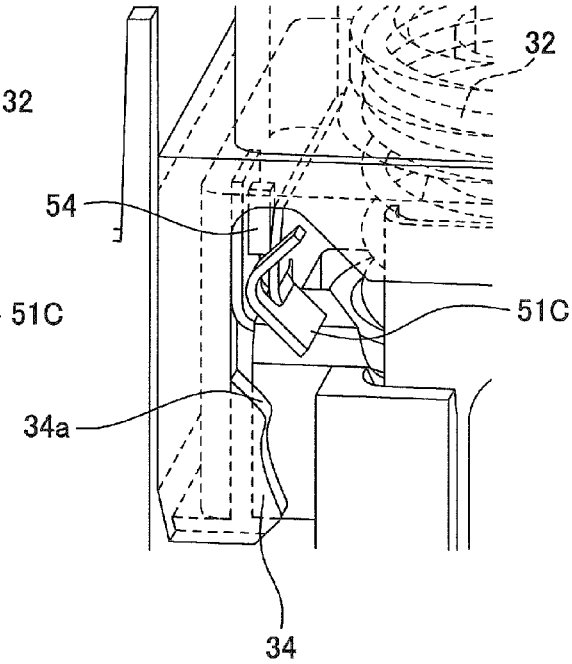

A method for operating the push-button switch 10 will be described below. FIG. 7 is a side view illustrating an engagement state between the plunger body 31 and the movable plate 51 before the operation of the push-button switch 10. FIGS. 8A and 8C are sectional perspective views illustrating a process of operating the push-button switch 10, and FIGS. 8B and 8D are partially enlarged views illustrating motions of the abutment portion 51C of the movable plate 51 and the cam portion 34 of the plunger body 31. The opening and closing motions of the movable contact 55 and fixed contact 54 by the pressing force in the push-button switch 10 will be described below. Because the opening and closing motions of the movable contact 56 and fixed contact 53 are similar to those of the movable contact 55 and fixed contact 54, the description is neglected.

As illustrated in FIGS. 7 and 8A, before the operation of the push-button switch 10, the upward force is applied to the lower portion 31B of the plunger body 31 by the spring force of the helical spring 32, and therefore the plunger body 31 is biased upward. Before the operation of the push-button switch 10, the abutment portion 51C of the movable plate 51 abuts on a convex surface 34$a_1$ of the concave-convex surface 34*a* of the cam portion 34 in the plunger body 31 with the apex portion 51$C_1$ interposed therebetween.

At this point, because the movable contact portion 51B of the movable plate 51 abuts on the cam portion 34 with the abutment portion 51C interposed therebetween, the movable contact portion 51B is elastically deformed toward the inside in the direction (hereinafter referred to as the horizontal direction) perpendicular to the Z-direction. Thus, before the operation of the push-button switch 10, the horizontally outward force is applied to the abutment portion 51C of the movable plate 51 by the elastic force of the movable contact portion 51B. Therefore, the abutment portion 51C is biased toward the horizontally outward direction. That is, the abutment portion 51C presses the cam portion 34 outward. The cam portion 34 of the plunger body 31 abuts on the apex portion 51$C_1$ of the abutment portion 51C of the movable plate 51 with the concave-convex surface 34*a* interposed therebetween, which latches the horizontally outward biasing force of the abutment portion 51C. At this point, the movable contact 55 provided in the movable contact portion 51B is separated from the fixed contact 54 provided in the fixed support 52D.

As illustrated in FIG. 8C, when the upper portion 31A of the plunger body 31 is pushed down, the helical spring 32 is bent, and the apex portion 51$C_1$ of the abutment portion 51C slides on the concave-convex surface 34*a* of the cam portion 34 while being biased toward the horizontally outward direction. When the upper portion 31A of the plunger body 31 is pushed down and the abutment portion 51C of the movable plate 51 is positioned above the cam portion 34, the cam portion 34 releases the operation to latch the horizontally outward biasing force of the abutment portion 51C. At this point, the movable contact 55 provided in the movable contact portion 51B comes into electrical contact with the fixed contact 54 provided in the fixed support 52D.

When the plunger body 31 releases the pressing force applied to the upper portion 31A, the helical spring 32 pushes up the plunger body 31. At this point, the abutment portion 51C slides on the concave-convex surface 34*a* of the cam portion 34 of the plunger body 31. Then the abutment portion 51C is latched in the convex surface 34$a_1$ of the concave-convex surface 34*a*. Therefore, the plunger body 31 and the movable plate 51 returns to the positions before the operation of the push-button switch 10.

In the push-button switch 10, the cam portion 34 of the plunger body 31 has the shape having the concave-convex surface 34*a* that is formed in the concave-convex manner in the direction perpendicular to the Z-direction. However, the cam portion 34 of the plunger body 31 is not limited to the shape having the concave-convex surface 34*a* that is formed in the concave-convex manner in the direction perpendicular to the Z-direction. The cam portion 34 may be formed into any shape as long as the dimension in the horizontal direction perpendicular to the Z-direction varies in the Z-direction and as long as the shape generates the horizontal elastic deformation with respect to the movable contact portions 51B and 52B. For example, the cam portion 34 of the plunger body 31 may be formed into the shape including an inclination surface inclined with respect to the Z-direction. More specifically, the cam portion 34 may be formed into the shape having the inclination surface that is inclined so as to bulge inward from the upper side toward the lower side.

The push-button switch 10 of the first embodiment includes the contact mechanism 50 including the opening and closing unit constructed by the movable contact 55 (movable contact 56) and the fixed contact 54 (fixed contact 53). The push-button switch 10 includes the lower case 60 having the quadratic-prism box shape and the plunger body 31 that is vertically movably attached to the quadratic prism in the axial direction (that is, the Z-direction) in the space of the lower case 60. In the lower case 60, the central space is defined by the communication pipe 61 and the insertion pipe 62. The plunger body 31 includes the cam portion 34 including the concave-convex surface 34*a* that is formed in the concave-convex manner in the horizontal direction perpendicular to the Z-direction. The contact mechanism 50 includes the movable plates 51 and 52 including the projected terminal portions 51A and 52A supported by the lower case 60. The movable plates 51 and 52 include the movable contact portions 51B and 52B in which the movable contacts 55 and 56 are provided, respectively. The movable contact portions 51B and 52B abut on the concave-convex surface 34*a* to be elastically deformed in the horizontal direction in conjunction with the vertical motion of the plunger body 31. By the elastic deformations of the movable contact portions 51B and 52B, the movable contacts 55 and 56 horizontally move to come into contact with or separate from the fixed contacts 54 and 53. In the push-button switch 10, the movable contact portions 51B and 52B are disposed while bent in the outer peripheral space between the insertion pipe 62 and the sidewalls 63 constituting the quadratic-prism lower case 60, and the sidewalls 63 closest to the positions where the projected terminal portions 51A and 52A are disposed differ from the sidewalls 63 closest to the positions where the portions (abutment portions 51C and 52C) coming into contact with the concave-convex surface 34*a* are disposed.

In the push-button switch 10, the force in the Z-direction by the plunger body 31 is converted into the force in the horizontal direction perpendicular to the Z-direction to bring the movable contact 55 (movable contact 56) and the fixed contact 54 (fixed contact 53) into contact with each other or to separate the movable contact 55 and the fixed contact 54 from each other, thereby implementing the opening and closing of the electrical contact. Therefore, the dimension of the push-button switch 10 can be reduced in the Z-direction.

At this point, the movable contact portions 51B and 52B are disposed while bent in the outer peripheral space between the insertion pipe 62 and the sidewalls 63 constituting the quadratic-prism lower case 60, and the sidewalls 63 closest to the positions where the projected terminal portions 51A and 52A are disposed differ from the sidewalls 63 closest to the positions where the portions (abutment portions 51C and 52C) coming into contact with the concave-convex surface 34*a* are disposed. Therefore, the distance between each of the projected terminal portions 51A and 52A that are of the support points and the "portion coming into contact with the concave-convex surface 34*a*" that is of the power point is lengthened, so that the force necessary to generate the elastic deformation of each of the movable contact portions 51B and 52B can be reduced. As to the technique of lengthening the distance between the support point (projected terminal portions 51A and 52A) and the power point (the portion coming into contact with the concave-convex surface 34*a*), for example, the movable contact portions 51B and 52B are configured to be bent along the sidewalls 63, so that the outer peripheral space between the insertion pipe 62 and the sidewalls 63 constituting the quadratic-prism lower case 60 can be reduced. As a result, the space where the member is disposed can be ensured in the center of the lower case 60 without changing the dimension of the appearance of the switch.

In the push-button switch 10, the quadratic-prism corner portion I closest to the position where the projected terminal portion 51A is disposed differs from the quadratic-prism corner portion III closest to the position where the portion (abutment portion 51C) coming into contact with the concave-convex surface 34*a* is disposed. The quadratic-prism corner portion III closest to the position where the projected terminal portion 52A is disposed differs from the quadratic-prism corner portion I closest to the position where the portion (abutment portion 52C) coming into contact with the concave-convex surface 34*a* is disposed. Therefore, the distance between the projected terminal portions 51A and 52A as the support points and "the portion coming into contact with the concave-convex surface 34*a*" as the power point can further be lengthened.

In the push-button switch 10, the contact mechanism 50 includes the two movable plates 51 and 52 and the two opening and closing units corresponding to the movable plates 51 and 52. Therefore, the contact reliability between the movable contact and fixed contact of the switch can be improved.

In the push-button switch 10, the two opening and closing units are disposed so as to be axisymmetrical with respect to the central axis of the Z-direction.

Because the two opening and closing units are disposed so as to be axisymmetrical with respect to the central axis of the Z-direction, during the pressing operation of the push-button switch 10, the force is not applied to the plunger body 31 while biased toward one direction, but the force is evenly applied to the plunger body 31 in the direction perpendicular to the Z-direction. Therefore, the abrasion of the specific portion of the plunger body 31 can be prevented to lengthen the lifetime of the switch.

In the push-button switch 10, the fixed supports 51D and 52D are formed in the movable plates 51 and 52 in order to fix the fixed contacts 53 and 54, respectively. Among the two movable plates 51 and 52, the fixed contact 53 provided in the fixed support 51D of the movable plate 51 constitutes the first opening and closing unit together with the movable contact 56 provided in the movable contact portion 52B of the movable plate 52. The fixed contact 54 provided in the fixed support 52D of the movable plate 52 constitutes the second opening and closing unit together with the movable contact 55 provided in the movable contact portion 51B of the movable plate 51.

According to the configuration, the movable contacts 55 and 56 and the fixed contacts 53 and 54 are provided in the movable plates 51 and 52, and the first opening and closing unit and the second opening and closing unit are constructed by the contacts provided in the movable plates 51 and 52 different from each other with respect to the movable contacts 55 and 56 and the fixed contacts 53 and 54. The number of components can be decreased, because the movable contacts 55 and 56 and the fixed contacts 53 and 54 are collectively provided in the movable plates 51 and 52 without separately providing the members used to move the movable contacts 55 and 56 and the members used to fix the fixed contacts 53 and 54. According to the configuration, additionally the space where the member is disposed can be ensured in the center of the lower case 60.

In the push-button switch 10, the light source 40 emits the light upward in the Z-direction in the central space of the lower case 60. The light source 40 includes the LED 41 mounted on the board 7 and the light guide rod 42 optically coupled to the LED 41.

By providing the light source 40 that emits the light upward in the Z-direction in the secured central space of the lower case 60, the lighted push-button switch in which the button operating surface homogeneously emits the light can be constructed without changing the dimensions of the appearance.

In the movable plates 51 and 52 of the push-button switch 10, the abutment portions 51C and 52C abutting on the concave-convex surface 34*a* and the projected terminal portions 51A and 52A are disposed in the spaces of the corner portions I to IV of the lower case 60.

Therefore, in the movable plates 51 and 52, the abutment portions 51C and 52C abutting on the concave-convex surface 34*a* and the projected terminal portions 51A and 52A are disposed in the spaces of the corner portions I to IV of the lower case 60 to effectively use the corner spaces of the lower case 60. Therefore, the space where the member is disposed can further be ensured in the center of the lower case 60.

In the configuration of FIGS. 1 to 3, the upper case 20 and the lower case 60 have the quadratic-prism box shapes. The upper case 20 and the lower case 60 are not limited to the quadratic-prism box shapes, but the upper case 20 and the lower case 60 may have polygonal-column box shapes. Even if the upper case 20 and the lower case 60 have the polygonal-column box shapes, each of the movable contact portions 51B and 52B are configured to extend from each of the projected terminal portions 51A and 52A along at least the two sidewalls 63 of the sidewalls 63 constituting the polygonal-column lower case 60. Therefore, the space where the member is disposed can be ensured in the center of the lower case 60 without changing the dimensions of the appearance of the switch.

In the movable plates 51 and 52, each of the movable contact portions 51B and 52B may have the dimension extending along at least the two sidewalls 63 adjacent to each other, and the dimension can properly be set according to the elastic forces necessary to open and close the switch in the movable contact portions 51B and 52B, the dimensions of the switch and the like.

Second Embodiment

Figure 9:
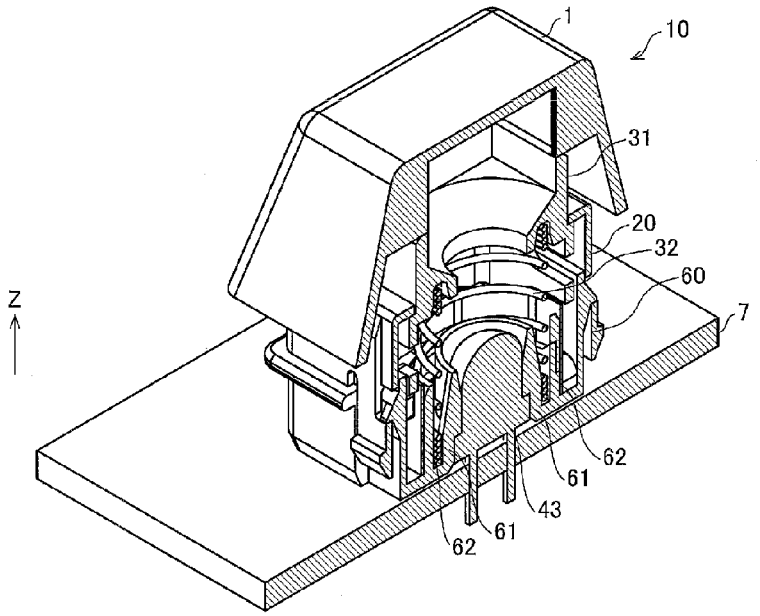
FIG. 9 is a sectional perspective view illustrating a configuration of a push-button switch according to a second embodiment of the present invention.

A second embodiment of the present invention will be described below with reference to FIG. 9. For the sake of convenience, elements of the second embodiment equivalent to those of the first embodiment are designated by consistent reference numerals, and a detailed description thereof is omitted, reference being made to the above-description of the first embodiment. FIG. 9 is a sectional perspective view illustrating a configuration of the push-button switch 10 of the second embodiment. FIG. 9 illustrates the non-pressing state.

In the push-button switch 10 of the first embodiment, the light source 40 including the LED 41 and the light guide rod 42 is disposed in the central space of the lower case 60, and the central space is ensured by the movable plates 51 and 52. However, the light source 40 disposed in the central space of the lower case 60 is not limited to the configuration including the light guide rod 42. The configuration of the light source 40 is properly set according to the dimensions of the push-button switch 10, and the like. For example, the light source 40 may be constructed by a shell type LED 43 when being able to be accommodated in the central space of the lower case 60.

As illustrated in FIG. 9, in the push-button switch 10 of the second embodiment, the shell type LED 43 is accommodated in the communication pipe 61 formed in the substantial center of the lower case 60. The shell type LED 43 is attached to the board 7. The shell type LED 43 emits the light upward to irradiate the keytop 1.

According to the push-button switch 10 of the second embodiment, use efficiency of the light emitted from the shell type LED 43 can be improved because necessity of the light guide rod 42 used in the optical coupling is eliminated.

Third Embodiment

Figure 10:
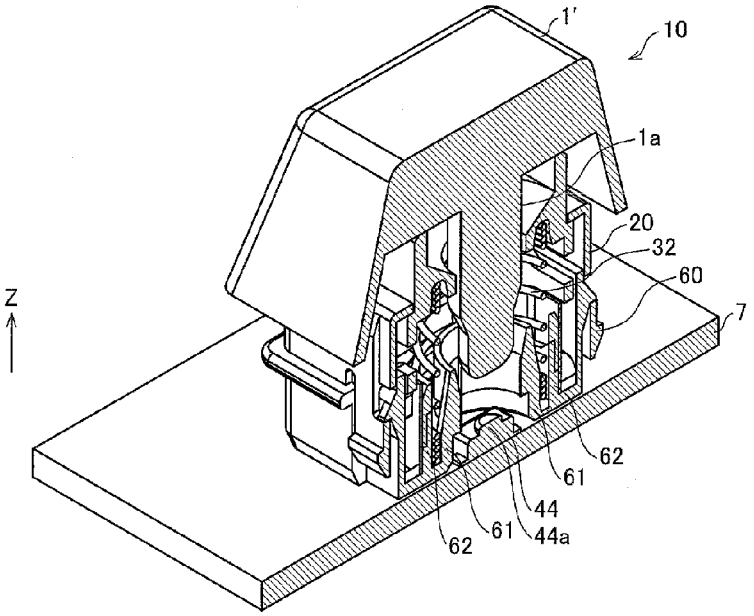
FIG. 10 is a sectional perspective view illustrating a configuration of a push-button switch according to a third embodiment of the present invention.
Figure 11:
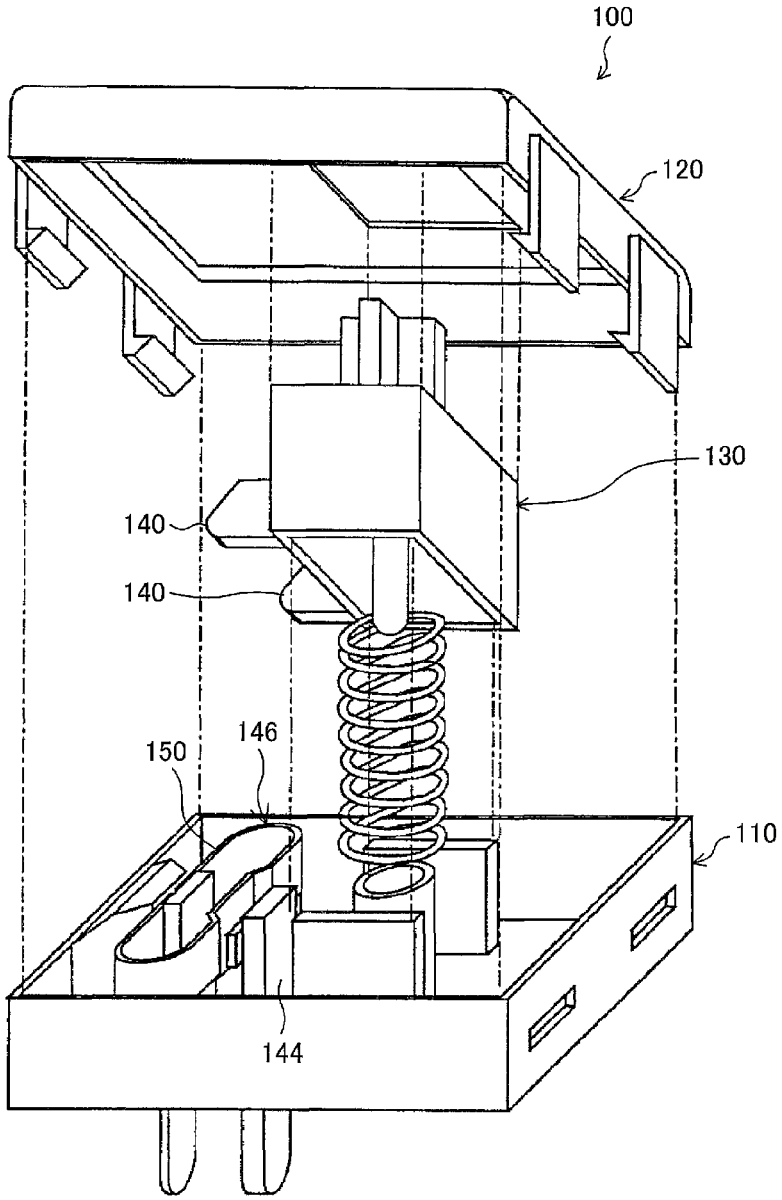
FIG. 11 Prior Art
FIG. 11 is an exploded perspective view illustrating a configuration of a flat key switch disclosed in International Patent Publication No. 8-504050.

A third embodiment of the present invention will be described below with reference to FIG. 10. For the sake of convenience, elements of the third embodiment equivalent to those of the first and/or second embodiments are designated by consistent reference numerals, and a detailed description thereof is omitted, reference being made to the above-description of the earlier embodiments. FIG. 10 is a sectional perspective view illustrating a configuration of the push-button switch 10 of the third embodiment. FIG. 10 illustrates the non-pressing state.

In the push-button switch 10 of the first and second embodiments, the light source 40 emitting the light toward the keytop 1 is disposed in the central space of the lower case 60, and the central space is ensured by the movable plates 51 and 52. However, the member disposed in the central space of the lower case 60 is not limited to the light source, but the member may properly be set according to the dimension of the push-button switch 10, and the like. For example, compact switches such as a tactile switch 44 may be provided as the member disposed in the central space of the lower case 60 when being able to be accommodated in the central space of the lower case 60.

As illustrated in FIG. 10, in the push-button switch 10 of the third embodiment, the tactile switch 44 is disposed immediately below the communication pipe 61 formed in the substantial center of the lower case 60. The tactile switch 44 is mounted on the board 7. A pressing shaft portion 1*a* extending downward is formed in the central portion of the keytop 1. The pressing shaft portion 1*a* is inserted in the communication pipe 61 of the lower case 60 by the pressing operation of the push-button switch 10. The tactile switch 44 includes a button portion 44*a* on the upper side thereof. By the pressing operation of the push-button switch 10, the pressing shaft portion 1*a* is inserted in the communication pipe 61 to come into contact with the button portion 44*a*, thereby turning on the tactile switch 44.

In the push-button switch 10 of the third embodiment, when the upper portion 31A of the plunger body 31 is pressed down to bring the movable contacts 55 and 56 into electrical contact with the fixed contacts 53 and 54, the pressing shaft portion 1*a* of the keytop 1 is not in contact with the button portion 44*a* of the tactile switch 44. After the movable contacts 55 and 56 come into electrical contact with the fixed contacts 53 and 54, the pressing shaft portion 1*a* is brought into contact with the button portion 44*a* by further pressing down a keytop 1', thereby turning on the tactile switch 44. According to the third embodiment, the push-button switch 10 can be used as the two-stage switch.

In the push-button switch 10 of the third embodiment, the tactile switch 44 that is of the compact switch is provided in the central space of the lower case 60, and the compact switch is configured such that the electric circuit is opened and closed after another electric circuit is turned on by the electrical contact between the movable contact 55 (movable contact 56) and the fixed contact 54 (fixed contact 53). Therefore, the push-button switch 10 can be used as a two-stage switch.

The present invention is not limited to the above embodiments, but various changes can be made without departing from the scope of claims of the present invention. An embodiment obtained by properly combining the different technical means disclosed in the embodiments is also included in the technical scope of the present invention.

The present invention relates to the contact type switch, particularly the present invention can be used as the switch incorporated in the keyboard, the industrial operation panel, the operation panel of the industrial video instrument and the consumer product.

As described, the invention provides a switch including: a contact mechanism that includes an opening and closing unit, the opening and closing unit including a movable contact and a fixed contact; a casing that is formed into a polygonal-column box shape, a central space of the casing being defined by an internal wall; and a pressing member that is attached while being vertically movable in an axial direction of the polygonal column in a space of the casing, the pressing member including a cam shape in which a dimension in a horizontal direction perpendicular to the axial direction varies in the axial direction. In the switch, the contact mechanism includes a plate-like member including a support supported by the casing, the plate-like member includes a movable contact portion in which the movable contact is provided, the movable contact portion abutting on the cam shape and being elastically deformed in the horizontal direction in conjunction with the vertical movement, the movable contact moves horizontally to come into contact with or separate from the fixed contact by an elastic deformation of the movable contact portion, the movable contact portion is disposed while bent in an outer peripheral space between the internal wall and sidewalls constituting the polygonal column, and the sidewall closest to a position where the support is disposed differs from the sidewall closest to a position where a portion coming into contact with the cam shape is disposed.

According to the configuration, the contact mechanism includes the plate-like member that includes the support supported by the casing. The plate-like member includes the movable contact portion in which the movable contact is provided. In the pressing member, the movable contact portion abuts on the cam shape in which the dimension in the horizontal direction perpendicular to the axial direction varies in the axial direction. The movable contact portion is elastically deformed in the horizontal direction in conjunction with the vertical movement. In the contact mechanism, by the elastic deformation of the movable contact portion, the movable contact moves horizontally to come into contact with or separate from the fixed contact. In the switch, the force in the direction of the vertical movement by the pressing member is converted into the force in the horizontal direction perpendicular to the direction of the vertical movement, and the fixed contact and the movable contact are brought into contact with or separated from each other, thereby implementing the opening and closing of the electrical contact. Therefore, the dimension of the switch can be reduced in the direction of the vertical movement.

According to the configuration, the movable contact portion is disposed while bent in the outer peripheral space between the internal wall and the sidewalls constituting the polygonal column, the sidewall closest to the position where the support is disposed differs from the sidewall closest to the position where the portion coming into contact with the cam shape is disposed. Therefore, a distance between the support that is of a support point and "the portion coming into contact with the cam shape" that is of a power point is lengthened, so that the force necessary to generate the elastic deformation of the movable contact portion can be reduced. As to a technique of lengthening the support point (the support) and the power point (the portion coming into contact with the cam shape), for example, the movable contact portion is configured to be bent along the sidewall, so that the outer peripheral space between the internal wall and the sidewalls constituting the polygonal column can be reduced. As a result, a volume of the central space can be enlarged without changing the dimensions of the casing. Therefore, according to the configuration, the space where the member is disposed can be ensured in the center of the casing without changing the dimensions of the appearance of the switch.

In the switch, preferably, in the polygonal column, a corner portion closest to the position where the support is disposed differs from a corner portion closest to the position where the portion coming into contact with the cam shape is disposed. Therefore, the distance between the support that is of the support point and "the portion coming into contact with the cam shape" that is of the power point can further be lengthened.

In the pressing member of the switch of the present invention, any "cam shape" may be used as long as the dimension in the horizontal direction perpendicular to the axial direction varies in the axial direction and as long as the elastic deformation is horizontally generated in the movable contact portion. A shape having a concave-convex surface horizontally formed in a concave-convex manner and a shape having an inclination surface inclined with respect to the axial direction can be cited as an example of the "cam shape".

In the switch, preferably the contact mechanism includes the two plate-like members and the two opening and closing units corresponding to the two plate-like members, respectively.

According to the configuration, the contact mechanism includes the two plate-like members and the two opening and closing units corresponding to the two plate-like members, respectively, so that contact reliability can be improved between the movable contact and fixed contact of the switch.

In the switch, preferably the two opening and closing units are disposed so as to become axisymmetrical with respect to a central axis of a direction of the vertical movement.

According to the configuration, because the two opening and closing units are disposed so as to become axisymmetrical with respect to the central axis of the direction of the vertical movement, during a pressing operation of the switch, the force is not applied to the pressing member while biased toward one direction, but the force is evenly applied to the pressing member in the direction perpendicular to the vertical movement. Therefore, abrasion can be prevented in a specific portion of the pressing member to lengthen a lifetime of the switch.

In the switch, preferably a fixed support configured to fix the fixed contact is formed in each plate-like member, in the two plate-like members, the fixed contact provided in the fixed support of a first plate-like member and the movable contact provided in the movable contact portion of a second plate-like member constitute a first opening and closing unit, and the fixed contact provided in the fixed support of the second plate-like member and the movable contact provided in the movable contact portion of the first plate-like member constitute a second opening and closing unit.

According to the configuration, the movable contact and the fixed contact are provided in each plate-like member, and the first opening and closing unit and the second opening and closing unit are constructed by the contacts included in the plate-like members different from each other with respect to the movable contacts and the fixed contacts. According to the configuration, the number of components can be decreased, because the movable contact and the fixed contact are collectively provided in the one movable plate without separately providing the member used to move the movable contact and the member used to fix the fixed contact. As a result, the space where the member is disposed can be ensured in the center of the casing.

In the switch, preferably a light source configured to emit light upward in the direction of the vertical movement is provided in the central space of the casing.

According to the configuration, the light source that emits the light upward in the direction of the vertical movement is provided in the central space of the casing ensured in the above manner. Therefore, the lighted push-button switch in which the button operating surface is homogeneously illuminated can be constructed without changing the dimensions of the appearance.

In the switch, the light source may include an LED mounted on a board and a light guide rod optically coupled to the LED.

In the switch, the light source may include a shell type LED. Therefore, use efficiency of the light can be improved.

In the switch, preferably a compact switch is provided in the central space of the casing, and the compact switch is configured to open and close an electric circuit after another electric circuit is turned on by electrical contact between the movable contact and the fixed contact.

According to the configuration, the compact switch is provided in the central space of the casing ensured in the above manner. The compact switch is configured to open and close the electric circuit after another electric circuit is turned on by the electrical contact between the movable contact and the fixed contact, so that the switch of the present invention can be used as a two-stage switch.

In the switch, preferably, in the plate-like member, an abutment portion abutting on the cam shape and the support are disposed in a corner space of the casing.

According to the configuration, in the plate-like member, the abutment portion abutting on the cam shape and the support are disposed in the corner space of the casing, and the corner space of the casing is effectively used. Therefore, the space where the member is disposed can further be ensured in the center of the casing.

As described above, in one aspect of the present invention, the switch includes: the casing that is formed into the polygonal-column box shape, the central space of the casing being defined by the internal wall; and the pressing member that is attached while being vertically movable in the axial direction of the polygonal column in the space of the casing, the pressing member including the cam shape in which the dimension in the horizontal direction perpendicular to the axial direction varies in the axial direction. In the switch, the contact mechanism includes the plate-like member including the support supported by the casing, the plate-like member includes the movable contact portion in which the movable contact is provided, the movable contact portion abutting on the cam shape and being elastically deformed in the horizontal direction in conjunction with the vertical movement, the movable contact moves horizontally to come into contact with or separate from the fixed contact by the elastic deformation of the movable contact portion, the movable contact portion is disposed while bent in the outer peripheral space between the internal wall and sidewalls constituting the polygonal column, and the sidewall closest to the position where the support is disposed differs from the sidewall closest to the position where the portion coming into contact with the cam shape is disposed.

Therefore, according to the present invention, advantageously the space where the member is disposed can be ensured in the center without changing the dimensions of the appearance.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A switch comprising:

a contact mechanism that comprises an opening/closing unit, the opening/closing unit comprising a movable contact and a fixed contact;

a casing including a polygonal-column box shape, a central space of the casing being defined by an internal wall; and a pressing member that is attached while being vertically movable in an axial direction of the polygonal-column box shape in a space of the casing, the pressing member comprising a cam shape in which a dimension in a horizontal direction perpendicular to the axial direction varies in the axial direction, wherein the contact mechanism comprises a plate-like member comprising a support supported by the casing, the plate-like member comprises a movable contact portion including the movable contact, the movable contact portion abutting on the cam shape and being elastically deformed in the horizontal direction in conjunction with the vertical movement, the movable contact being movable horizontally to come into contact with or separate from the fixed contact by an elastic deformation of the movable contact portion, the movable contact portion is disposed while bent in an outer peripheral space between the internal wall and sidewalls constituting the polygonal-column box shape;

the movable contact portion extends from the support and along a first sidewall of the polygonal-column box shape, astride a corner portion of the polygonal-column box shape, extends along a second sidewall of the polygonal-column box shape and reaches a portion; and wherein the portion comes into contact with the cam shape after pressing of the pressing member.

2. The switch according to claim 1, wherein, in the polygonal-column box shape, a corner portion closest to the position where the support is disposed differs from a corner portion closest to the position where the portion coming into contact with the cam shape is disposed.

3. The switch according to claim 2, wherein the contact mechanism comprises two plate-like members, the two plate-like members forming two opening/closing units, each opening/closing unit being able to open and close.

4. The switch according to claim 3, wherein the two opening/closing units are disposed so as to become symmetrical about a central axis, the central axis indicating a direction of the vertical movement.

5. The switch according to claim 4, wherein each plate-like member includes a fixed support configured to fix the fixed contact, in the two plate-like members, a first contact is a fixed contact in the fixed support of a first plate-like member and a second contact is a movable contact in the movable contact portion of a second plate-like member, wherein the first contact and the second contact constitute a first opening/closing unit, and a third contact is a fixed contact in the fixed support of the second plate-like member and a fourth contact is a movable contact in the movable contact portion of the first plate-like member, wherein the third contact and the fourth contact constitute a second opening/closing unit.

6. The switch according to claim 3, wherein each plate-like member includes a fixed support configured to fix the fixed contact, in the two plate-like members, a first contact is a fixed contact in the fixed support of a first plate-like member and a second contact is a movable contact in the movable contact portion of a second plate-like member, wherein the first contact and the second contact constitute a first opening/closing unit, and a third contact is a fixed contact in the fixed support of the second plate-like member and a fourth contact is a movable contact in the movable contact portion of the first plate-like member, wherein the third contact and the fourth contact constitute a second opening/closing unit.

7. The switch according to claim 2, wherein a light source configured to emit light upward in the direction of the vertical movement is disposed in the central space.

8. The switch according to claim 2, wherein a compact switch is disposed in the central space, and the compact switch is configured to open and close an electric circuit after another electric circuit is turned on by electrical contact between the movable contact and the fixed contact.

9. The switch according to claim 1, wherein the contact mechanism comprises two plate-like members, the two plate-like members forming two opening/closing units, each opening/closing unit being able to open and close.

10. The switch according to claim 9, wherein the two opening/closing units are disposed so as to become symmetrical about a central axis, the central axis indicating a direction of the vertical movement.

11. The switch according to claim 10, wherein each plate-like member includes a fixed support configured to fix the fixed contact, in the two plate-like members, a first contact is a fixed contact in the fixed support of a first plate-like member and a second contact is a movable contact in the movable contact portion of a second plate-like member, wherein the first contact and the second contact constitute a first opening/closing unit, and a third contact is a fixed contact in the fixed support of the second plate-like member and a fourth contact is a movable contact in the movable contact portion of the first plate-like member, wherein the third contact and the fourth contact constitute a second opening/closing unit.

12. The switch according to claim 10, wherein a light source configured to emit light upward in the direction of the vertical movement is disposed in the central space.

13. The switch according to claim 9, wherein each plate-like member includes a fixed support configured to fix the fixed contact, in the two plate-like members, a first contact is a fixed contact in the fixed support of a first plate-like member and a second contact is a movable contact in the movable contact portion of a second plate-like member, wherein the first contact and the second contact constitute a first opening/closing unit, and a third contact is a fixed contact in the fixed support of the second plate-like member and a fourth contact is a movable contact in the movable contact portion of the first plate-like member, wherein the third contact and the fourth contact constitute a second opening/closing unit.

14. The switch according to claim 13, wherein a light source configured to emit light upward in the direction of the vertical movement is disposed in the central space.

15. The switch according to claim 9, wherein a light source configured to emit light upward in the direction of the vertical movement is disposed in the central space.

16. The switch according to claim 1, wherein a light source configured to emit light upward in the direction of the vertical movement is disposed in the central space.

17. The switch according to claim 16, wherein the light source comprises an LED mounted on a board and a light guide rod optically coupled to the LED.

18. The switch according to claim 16, wherein the light source comprises a shell type LED.

19. The switch according to claim 1, wherein a compact switch is disposed in the central space, and the compact switch is configured to open and close an electric circuit after another electric circuit is turned on by electrical contact between the movable contact and the fixed contact.

20. The switch according to claim 1, wherein, in the plate-like member, an abutment portion abutting on the cam shape and the support are disposed in a corner space of the casing.

* * * * *